US011633644B2

(12) United States Patent
River et al.

(10) Patent No.: US 11,633,644 B2
(45) Date of Patent: Apr. 25, 2023

(54) DYNAMIC NECK MUSCLE EXERCISER

(71) Applicants: Yaron River, Tiveon (IL); Itzhak Pomerantz, Kefar Sava (IL); Erez Bachar, Jerusalem (IL)

(72) Inventors: Yaron River, Tiveon (IL); Itzhak Pomerantz, Kefar Sava (IL); Erez Bachar, Jerusalem (IL)

( * ) Notice: Subject to any disclaimer, the term of this patent is extended or adjusted under 35 U.S.C. 154(b) by 47 days.

(21) Appl. No.: 16/970,834

(22) PCT Filed: Feb. 21, 2019

(86) PCT No.: PCT/IB2019/051409
§ 371 (c)(1),
(2) Date: Aug. 18, 2020

(87) PCT Pub. No.: WO2019/162864
PCT Pub. Date: Aug. 29, 2019

(65) Prior Publication Data

US 2020/0384310 A1 Dec. 10, 2020

Related U.S. Application Data

(60) Provisional application No. 62/633,244, filed on Feb. 21, 2018.

(51) Int. Cl.
*A63B 23/025* (2006.01)
*A61H 1/02* (2006.01)
(Continued)

(52) U.S. Cl.
CPC ..... *A63B 23/025* (2013.01); *A61H 1/0296* (2013.01); *A63B 21/065* (2013.01);
(Continued)

(58) Field of Classification Search
CPC . A63B 23/025; A63B 21/0608; A63B 21/065; A63B 71/0622; A63B 2071/0627;
(Continued)

(56) References Cited

U.S. PATENT DOCUMENTS 1,530,748 A * 3/1925 Alastalo ..... A63B 21/0608 482/110
2,051,366 A * 8/1936 Catron ..... A63B 23/025 482/110

(Continued)

FOREIGN PATENT DOCUMENTS

DE 102 33 405 2/2004
DE 202011103678 7/2012

*Primary Examiner* — Garrett K Atkinson
(74) *Attorney, Agent, or Firm* — The Law Office of Joseph L. Felber

(57) ABSTRACT

The present invention may be embodied as a system or method for dynamically exercising a user's neck muscles. The system includes a headset, an arm attached thereto, a weight, and at least one motor to move the weight, for example, about the arm. The weight may be mounted eccentrically on a radial track that is rotatable by one motor and moved linearly by another motor. The direction of the arm, the distance between an apex of the headset and the weight, the eccentricity of the weight on the axis, and the speed of rotation of the motor are all parameters that can be adjusted by the caregiver or user, either manually or via controlling software.

14 Claims, 8 Drawing Sheets

(51) Int. Cl.
*A63B 21/06* (2006.01)
*A63B 21/065* (2006.01)
*A63B 71/06* (2006.01)

(52) U.S. Cl.
CPC ..... *A63B 21/0608* (2013.01); *A63B 71/0622* (2013.01); *A63B 2071/0627* (2013.01); *A63B 2071/0655* (2013.01); *A63B 2209/00* (2013.01); *A63B 2220/18* (2013.01); *A63B 2220/40* (2013.01); *A63B 2220/836* (2013.01)

(58) Field of Classification Search
CPC ..... A63B 2071/0655; A63B 2209/00; A63B 2220/18; A63B 2220/40; A63B 2220/836; A63B 21/00072; A63B 21/00196; A63B 21/0023; A63B 21/00076; A63B 21/0058; A63B 21/4003; A63B 21/4043; A63B 2071/065; A63B 2220/80; A63B 2220/833; A61H 1/0296; A61H 2201/1215; A61H 2201/1604; A61H 2201/165; A61H 2201/5007; A61H 2201/5048; A61H 2201/5069; A61H 2205/04; A61H 23/0263
See application file for complete search history.

(56) References Cited

U.S. PATENT DOCUMENTS 2,958,156 A * 11/1960 Schmahl ..... A63B 67/10 242/380
3,184,884 A * 5/1965 Petrucelli ..... A63B 21/0608 473/576
3,751,031 A * 8/1973 Yamauchi ..... A63B 21/065 606/241
3,866,910 A * 2/1975 Herring ..... A63B 67/08 434/290
3,901,505 A * 8/1975 Gerechter ..... A63F 7/38 473/576
4,168,060 A * 9/1979 Hohenfeldt ..... A63B 21/4003 482/10
4,339,124 A * 7/1982 Vogler ..... A63B 23/025 482/10
4,893,808 A * 1/1990 McIntyre ..... A63B 23/025 482/901
5,116,359 A * 5/1992 Moore ..... A61H 1/008 601/25
5,984,836 A * 11/1999 Casali ..... A63B 21/4003 602/17
6,000,066 A * 12/1999 Williams ..... A63B 21/4003 2/209.13
6,991,556 B2 * 1/2006 LaTerra ..... A63B 69/3608 473/274
7,104,926 B2 * 9/2006 Carlson ..... A63B 21/023 601/39
7,189,192 B2 * 3/2007 Edgeton ..... A63B 23/025 482/10
7,722,301 B2 * 5/2010 Rosenblum ..... A63B 21/4003 482/131
D729,879 S * 5/2015 Green ..... D21/399
9,198,820 B2 * 12/2015 Philipson ..... A63B 21/065
9,211,438 B2 * 12/2015 Versteegh ..... A61B 5/224
9,498,675 B2 * 11/2016 Walworth ..... A63B 21/00061
9,526,965 B2 * 12/2016 Gatherer ..... A63B 21/4011
9,555,283 B2 * 1/2017 Jolly ..... A63B 23/025
9,962,575 B2 * 5/2018 Askins ..... A63B 23/025
10,143,883 B2 * 12/2018 Jolly ..... A63B 21/0608
10,328,304 B2 * 6/2019 Versteegh ..... G16H 20/30
11,020,631 B2 * 6/2021 Walker ..... A63B 21/0085
2004/0033869 A1 * 2/2004 Carlson ..... A63B 21/156 482/121
2015/0072836 A1 * 3/2015 Versteegh ..... A61B 5/7275 482/10
2016/0101011 A1 * 4/2016 Swenson ..... A61H 1/0296 482/10
2016/0213973 A1 * 7/2016 Walworth ..... A42B 3/0406
2017/0189746 A1 * 7/2017 Versteegh ..... A61B 5/1121

* cited by examiner

DYNAMIC NECK MUSCLE EXERCISER

RELATED APPLICATION

This application claims benefit under 35 U.S.C. § 119(e) of the Feb. 21, 2018 filing of U.S. Provisional Application No. 62/633,244, which is hereby incorporated by reference in its entirety.

BACKGROUND

Neck pain and headaches are often associated with postural abnormalities, reduced neck muscles' gross motor skills, and limited range of neck movement. The need to exercise neck muscles as a treatment for certain neck pain syndrome is well recognized in physical therapy and pain research literature. One way of exercising neck muscles is installing an eccentric weight on a wearable head mount and requiring the patient to maintain his head in a pre-determined posture and balance the weight with his/her neck muscles. Such systems are described in the prior art, for example, in the following:

1. US patent application no. US2015072836 (A1)—Neck muscle exerciser and method of assessing neck muscle performance.
2. Chinese patent no. CN101822893 (A)—Device for training neck muscle force
3. German patent no. DE20120285 (U1)—Trainingsgerät für den menschlichen Körper (Exerciser for the human body)
4. Denmark patent no. DK177843 (B1)—Test and Training helmet Common to all these and other prior art solutions is that the mechanical load on the muscles is stationary. It can be manually moved by changing the radius and the mass of the weight(s) to adjust the moment, but once the moment is set, it stays fixed throughout the patient's treatment.

Such apparatuses are limited for diagnostic purposes, as precise diagnoses of specific muscles require delicate and slight changes in the moment applied to the head and following the patient's feedback on the precise position that is associated with the pains that they experience.

The apparatuses are also limited for treatment purposes, as good exercise for a muscle requires cyclic stretch and release of the muscle, both concentric and eccentric efforts, and such is not possible with a fixed moment. Such a system for this exercise would challenge the premotor central nervous system, as it would necessitate adaptive dynamic strategies to balance the head.

Accordingly, it would be very useful if a device could be available where the moment that the muscle must apply can continuously change and periodically does change. It would be even more useful if the direction of change of the moment could be adjusted according to the anatomical position and physiological functions of the treated muscles.

Definition of Terms:

Neck—for the sake of simplicity, this application discloses the invention in the context of the neck as it is used in common language. However it should be clear that this invention applies, with obvious modifications, to any other appendage of the body that is an extension of the torso and is controlled by muscles, such as arms and legs.

Headset—a system intended to be worn on the head of a user

Moment—a measure of a tendency of a force to cause a body to rotate about an axis

SUMMARY

Embodiments of the present invention include a neck exercising device having a headset, an arm, a motor, and a weight, and a method for the device's use.

In a preferred embodiment of the invention the weight is mounted eccentrically on a radial track that is rotatable by one motor and extendable by another motor. An optional third motor, and the weight are mounted on the arm. The arm is mounted on the apex of the headset. The direction of the arm, the distance between the apex of the headset and the weight, the eccentricity of the weight on the axis, and the speed of rotation of the motor are all parameters that can be adjusted by a caregiver or user, either manually or via controlling software.

When the user wears the headset while the motor is operating, a moment is applied to the head and neck, and this moment necessitates neck muscle adaptation to maintain proper neck posture. Due to the angular and radial motion and the rotation of the eccentric weight this moment changes continuously and/or periodically at a desired amplitude and speed. If the user is trying to keep his/her head straight, certain neck muscles are exercised to provide the proper positioning.

In a preferred embodiment of the invention, an indication can be given to the user, typically by a sound or by a vibrator in contact with the user's skull, which provides a directional error message when the head is determined to be at an improper orientation.

In a preferred embodiment of the invention, the error message is created in a smartphone that is mounted on the headset using a software application that obtains information from the phone's accelerators and inclinometers.

In a preferred embodiment of the invention, the error message is created in the electronics of the system using an inertial measurement unit.

In a preferred embodiment the inertial measurement unit is electromechanical.

In a preferred embodiment the inertial measurement unit is solid state.

In a preferred embodiment the inertial measurement unit is a smartphone that is mounted on the headset using a software application that obtains information from the phone's accelerators and inclinometers.

In a preferred embodiment of the invention, The patient will be playing a game in which he/she is challenged to do precise head movements while the moment of the eccentric weight of the headset is changed or modulated.

Embodiments of the invention are operated as follows: based on the patient's initial neck posture, the strength of different neck muscle groups, and the specific head and neck pain syndrome, a therapist makes a decision with regard to the direction of the arm, the speed of rotation, etc. For example, patients with forward neck tilting, multiple trigger points in neck extensor muscles will benefit from weights applied posterior to the head that would require activation of neck flexor muscles and would reduce the tension and the over activation of neck extensor muscles.

A different utilization of this device is in the treatment of neck dystonia, Dystonia is a condition brought about by abnormal functioning of the brain motor networks. An abnormal posture of the neck is established due to the incorrect activation of the neck muscles. By changing the moment on the head and neck muscles a different combination of weight and moment is reached with normalization of the posture.

Embodiments of the present invention are described in detail below with reference to the accompanying drawings, which are briefly described as follows:

BRIEF DESCRIPTION OF THE DRAWINGS

The invention is described below in the appended claims, which are read in view of the accompanying description including the following drawings, wherein:

DETAILED DESCRIPTION OF THE DRAWINGS

Figure 1:
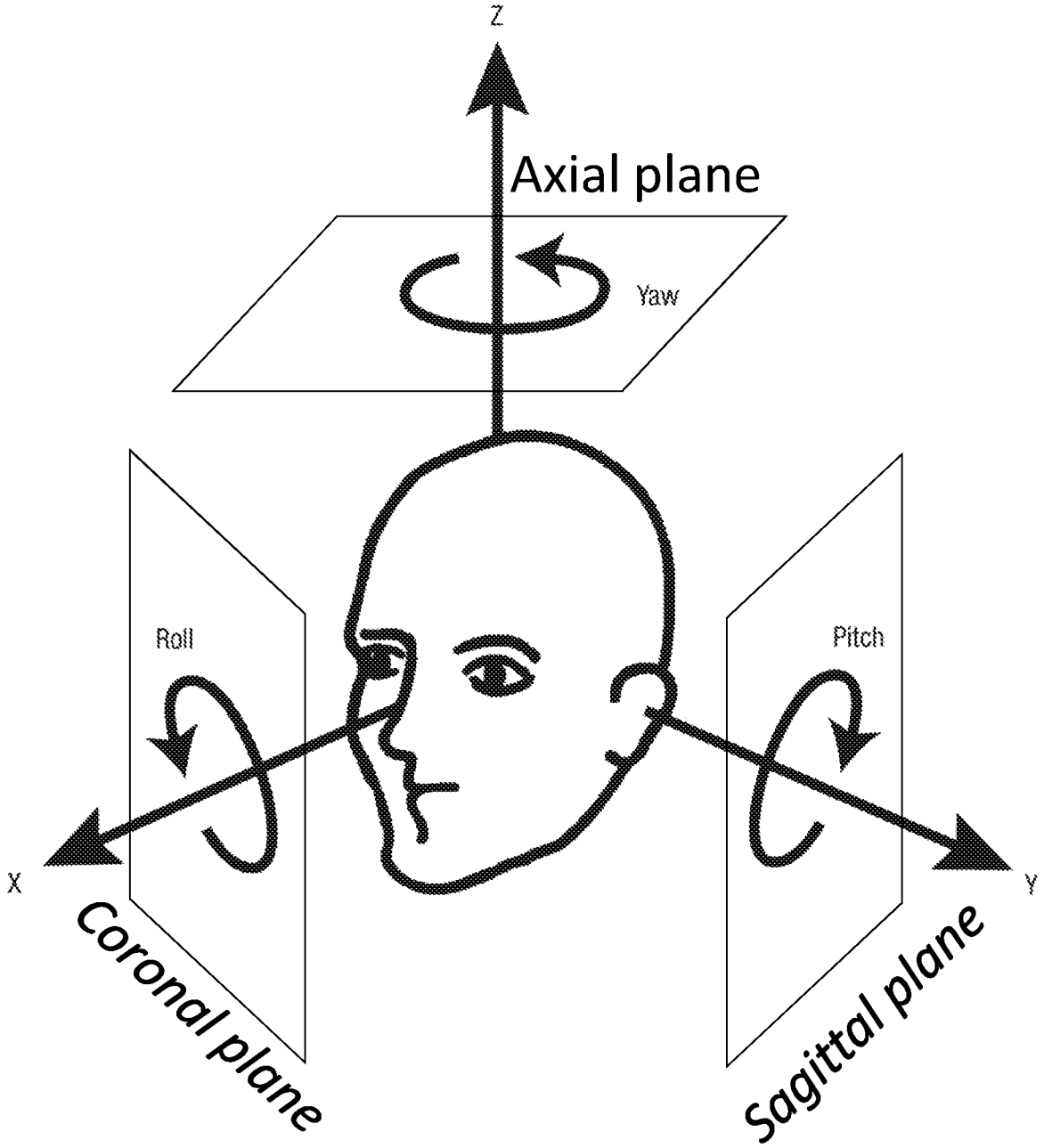
FIG. 1 provides a definition of axes used in the description of embodiments of the invention.

Attention is now directed to FIG. 1. This figure defines the translational and rotational axes as those terms are used in this specification.

Figure 2:
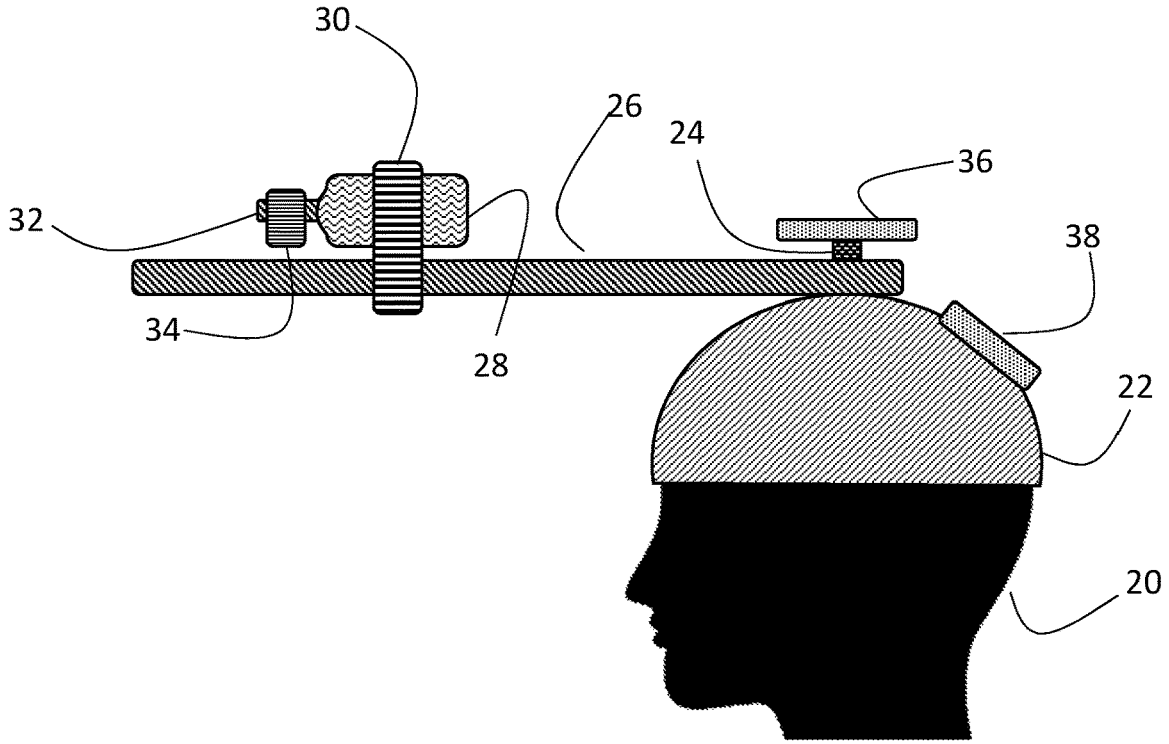
FIG. 2 shows a dynamic neck muscle trainer with a radial axis.

Attention is now directed to FIG. 2 showing a user 20 wearing a headset 22. The headset 22 may be a helmet, hair bow, hat, or any other wearable device that can rest firmly and conveniently affixed to the user's skull.

A radial arm 26 made of any strong and light-weight material, such as plastic, wood, or aluminum, extends from the apex of the headset and rotates in a horizontal plane about an axis 24. Friction or other means of fastening keeps the arm 26 in a fixed orientation relative to the headset.

A motor 28 increases the moment of arm 26 and may include gearing to change the speed of rotation. The motor 28 is attached to the arm 26 by a band 30. The band allows the user to slide the motor along the arm 26 and to fix it in place. An eccentric weight 34, possibly made of a set of heavy eccentric disks, is fixed to the motor axis 32. The mass of the weight can be adjusted by adding or removing disks.

Electricity supplied by a battery 38 on the headset powers the motor. An electronic device 36, such as a dedicated inertial movement unit or a general purpose smartphone, has means to measure the orientation of the head in space using a software application that implements orientation sensors. Such orientation sensors are typically available on modern smart phones. Alternatively, device 36 can be a dedicated device that is designed for the system of the present embodiment and comprises means to measure and record the pitch, roll, and yaw angles of the headset. Additionally, the device 36 is configured, using commercially available text-to-speech software, to send correction messages to the user, alerting him/her when his/her head is inclined away from a desired head position. The message can be played to the user by audio via a speaker on the head set or via earphones in place near or in the user's ears.

Device 36 enables the utilization of the exact position of the headset in three-dimensional space as an input to a virtual reality based software that would require knowledge of precise head movements.

As a result of the eccentric motion of the weight around the X axis, a cyclic moment in the pitch and yaw dimensions is applied to the head and neck. The attachment band 30 can be sled forward and backward along the arm 26, and the mass and eccentricity of the weight 34, as well as the rotational speed of the motor, can be adjusted to change the amplitude and frequency of the moment cycles.

Figure 3:
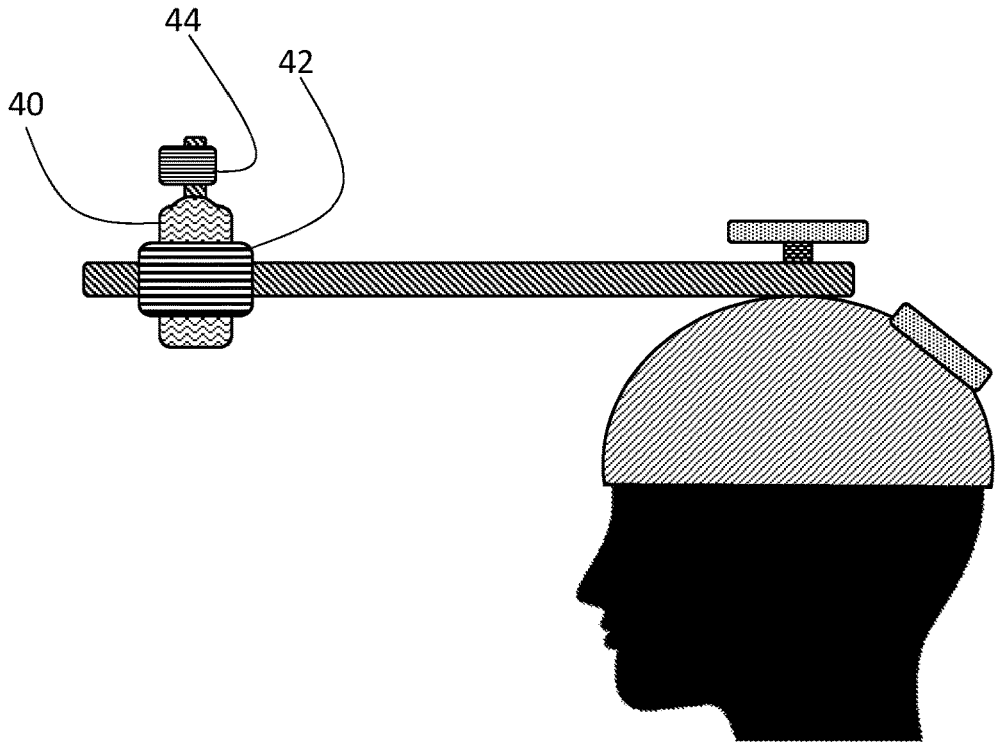
FIG. 3 shows a dynamic neck muscle trainer with vertical axis.

Attention is now directed to FIG. 3, which shows a similar system to that in FIG. 2 but having a different orientation of the motor axis. The band 42 connects the motor 40 to the arm of the system so that the weight 44 rotates around a vertical axis. The moment applied to the head is now in the yaw and roll dimensions.

Figure 4:
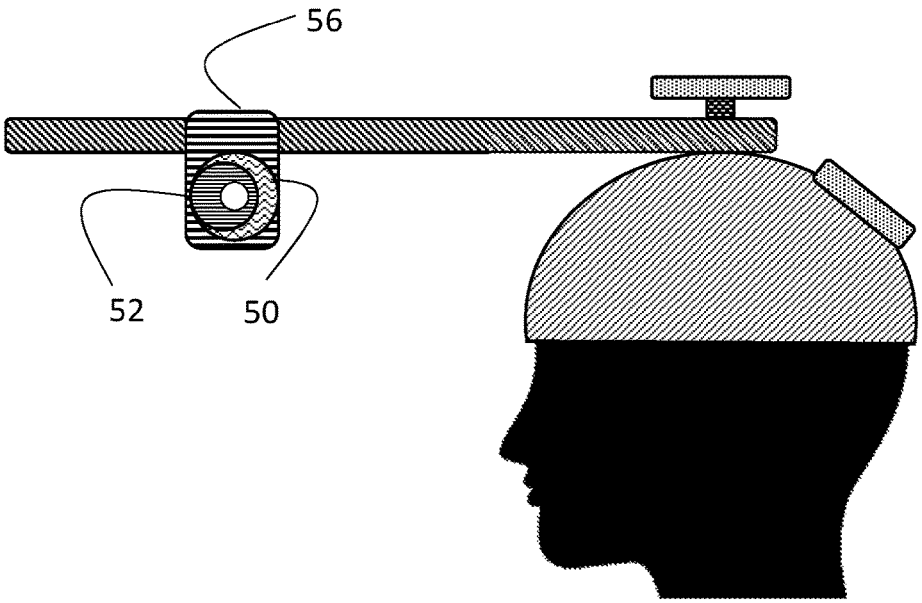
FIG. 4 shows a dynamic neck muscle trainer with tangential axis.

Attention is now directed to FIG. 4, which shows a similar system to that in FIGS. 2 and 3 but having a different orientation of the motor axis. The band 56 connects the motor 50 to the arm of the system so that the weight 52 rotates around a horizontal axis parallel to the Y coordinate. The moment applied to the head is now mainly in the roll dimension.

In all the configurations shown in FIGS. 2-4, the amplitude of the applied moment is determined by the mass of the weight, its eccentricity, and its distance from the apex of the headset. These parameters are easily adjusted by a user or caregiver.

Figure 5:
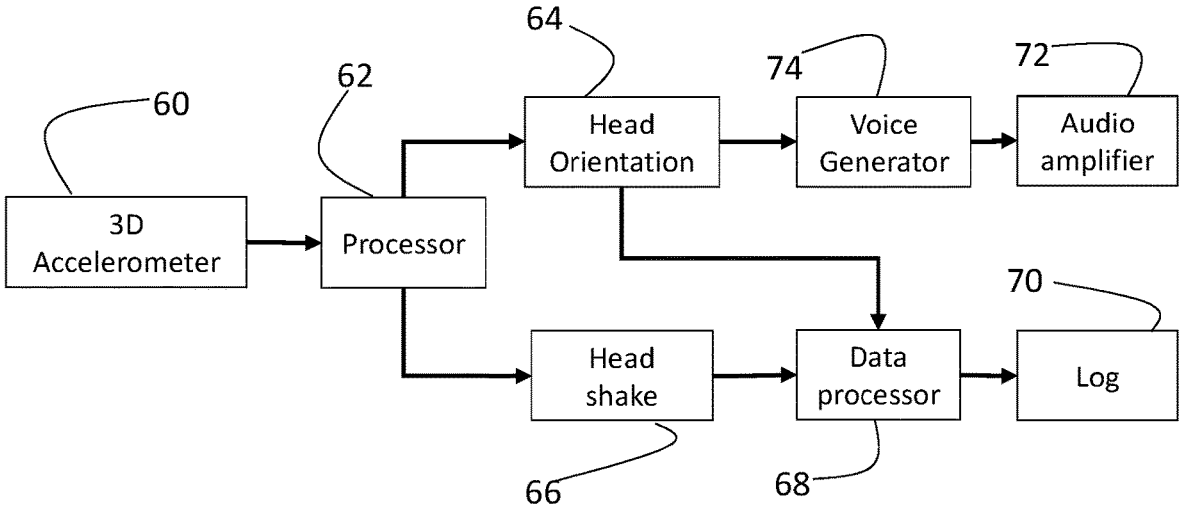
FIG. 5 shows a simplified block diagram of a monitoring system may be mounted on a headset according to one embodiment of the invention.

Attention is now called to FIG. 5, which provides a block diagram of one embodiment of a monitoring system that is preferably mounted on the headset. The system includes accelerometers, or inclinometers, 60 that are built-in as a dedicated inertial movement unit or alternatively are part of a smartphone used with the system. The accelerometers 60 provide signals that can be processed in a processor 62 to determine the orientation of the headset in all three rotational directions. Sensors and software are applied in software applications for smartphones that serve to determine attitude/orientation, such as Bubble Level and Smart Level, both of which are available on Google Play.

Information about the head orientation (roll, pitch, yaw) is processed to detect whether the user's head is inside of or outside of a normal envelope set by the caregiver. If the orientation of the head of the user is not within the normal envelope, as set by a caregiver, a voice generator 74 generates an alert message such as "forward" or "leftward" that is amplified in an amplifier 72 and played to the user via speakers or earphones. This gives the user real-time feedback that guides him to correct the head orientation.

The signals from the processor 62 also go into a head shake monitor 66 that calculates the amplitude of head shaking, which is indicative of the ability of the user to restrain the moment of the eccentric weigh using his neck muscles. The information together with the data on head orientation is input to a data processor 68 and is recorded on a log 70 that can serve the user and the caregiver for monitoring the user's treatment off-line.

Figure 6A:
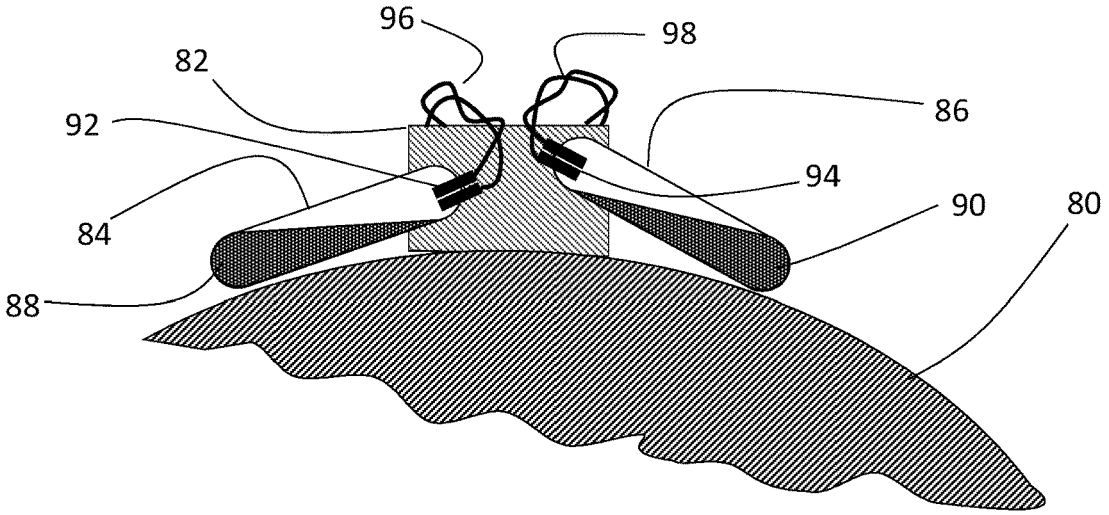
FIGS. 6A-6C show an alternative angle sensor.

Attention is now directed to FIG. 6A.

The top of a user's skull 80 is shown in a normal posture, and a device 82 is attached to it comfortably (attachment means not shown). Four inclination Single-Pole, Single-Throw (SPST) mercury switches (such as those described in Handbook of Modern Sensors—Physics, Designs and Applications (3rd Edition). Springer-Verlag. pp. 256-257) 84, 86, and two others not shown for clarity, are mounted diagonally on the device, facing front, rear, right and left sides of the skull. Alternatively, and preferably, electronic inclinometers such as "High Accuracy Digtial Output 1-Axis MEMS Inclinometer Tilt Sensor" available from ZC, 3F, #6 Building, No. 639 Guangzhong Road, Minhang, Shanghai, 201108, China may be used. The switches are arranged so that their slopes, when the user exhibits proper posture, keep the mercury 88, 90 in the switches from reaching the electrodes 92, 94 thus preventing electric flow through the switches. Electric wires 96, 98 lead from the electrodes 92, 94, respectively, to the device and to a controller (not shown).

Figure 6B:
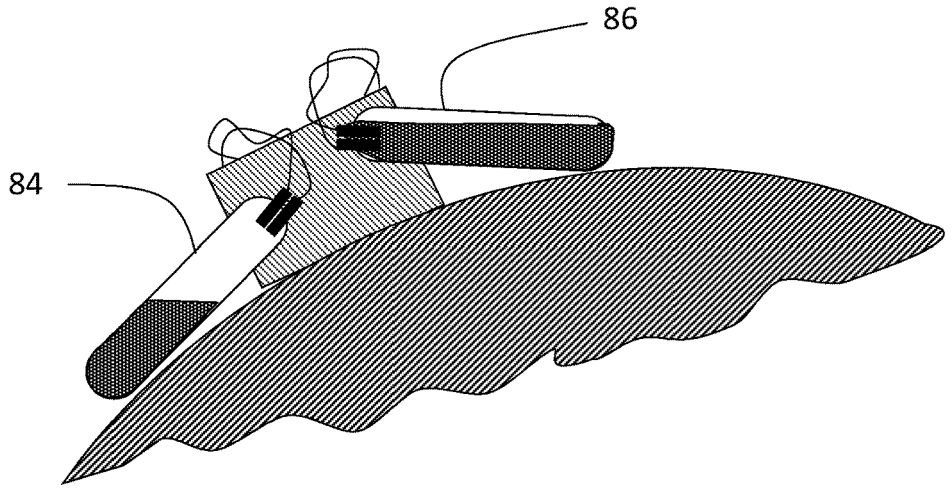

The inclination of switch 86, which is the rear switch, is adjusted so that when the skull leans forwards, as shown in FIG. 6B, the switch 86 is closed and conducts current, while the front switch 88 remains open.

Figure 6C:
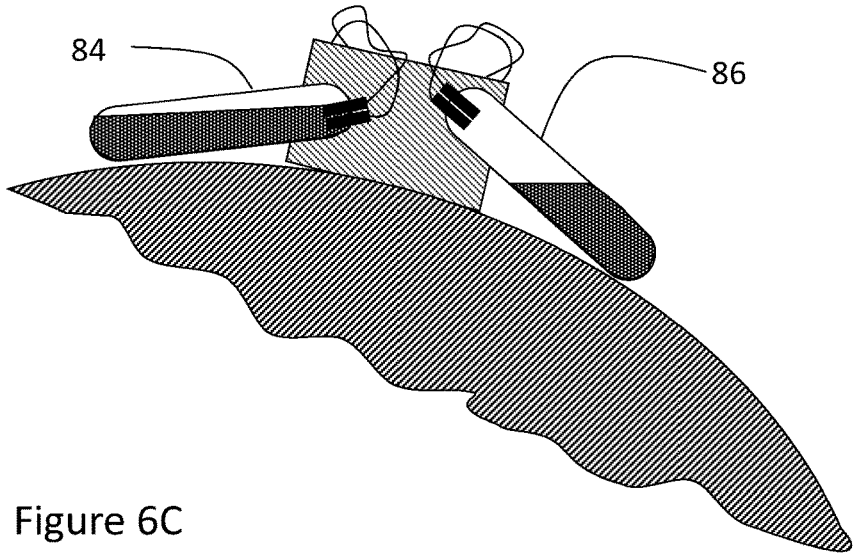

The inclination of switch 84, which is the rear front, is adjusted so that when the skull leans backwards, as shown in FIG. 6C, the switch 84 is closed and conducts current, while the front switch 86 remains open.

In similar way, inclination to the left closes the right-side switch and inclination to the right closes the left-side switch.

The switches can be made implementing other technologies used in the art for sensing inclination.

The controller can determine from the conductance of the four switches whether and in which direction the skull is inclined and can then output voice instructions as described in FIG. 5 and accompanying text.

Figure 7:
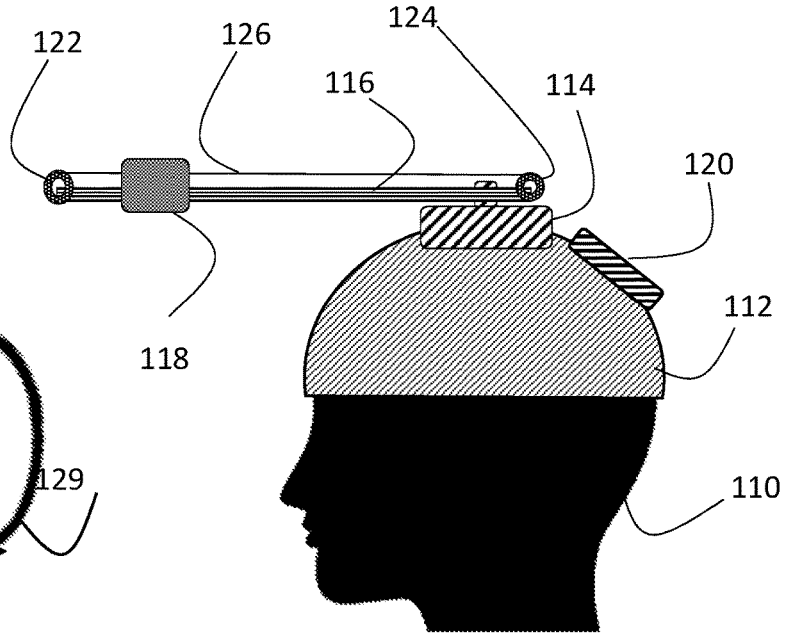
FIG. 7 shows a trainer with axial rotation of the arm.

Attention is now directed to FIG. 7, showing another preferred embodiment. The patient 110 is wearing a headset 112 with a controlled motor 114 at the apex of the skull. The motor carries an arm 116 and can rotate the arm about a vertical axis. The limits of the scan angle and the duration of the rotation cycle can be controlled.

A weight 118 is mounted on the arm. The moment of the weight on the skull changes with the distance between the weight and the axis, which is the radius of its rotation.

Another motor (not shown) on the arm rotates a pully wheel 124 and a wire 126 connected to the weight 118 and then to another wheel 122. The weight is mounted on a rail (not shown) so that by rotating the second motor, the wire pulls the weight along the rail (very much like a printhead of a printer). This positions the weight at different locations along the arm, so that the moment of the weight on the head can be changed continuously and automatically. This dynamic moment has a medical value in treating a patient. Batteries and a controller are located in a box 120 on the back of the headset.

Figure 8A:
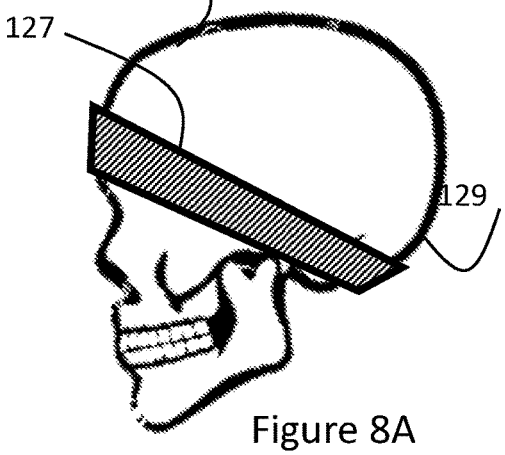
FIGS. 8A and 8B illustrate the placement of a helmet on a user's head in accordance with one embodiment of the invention.
Figure 8B:
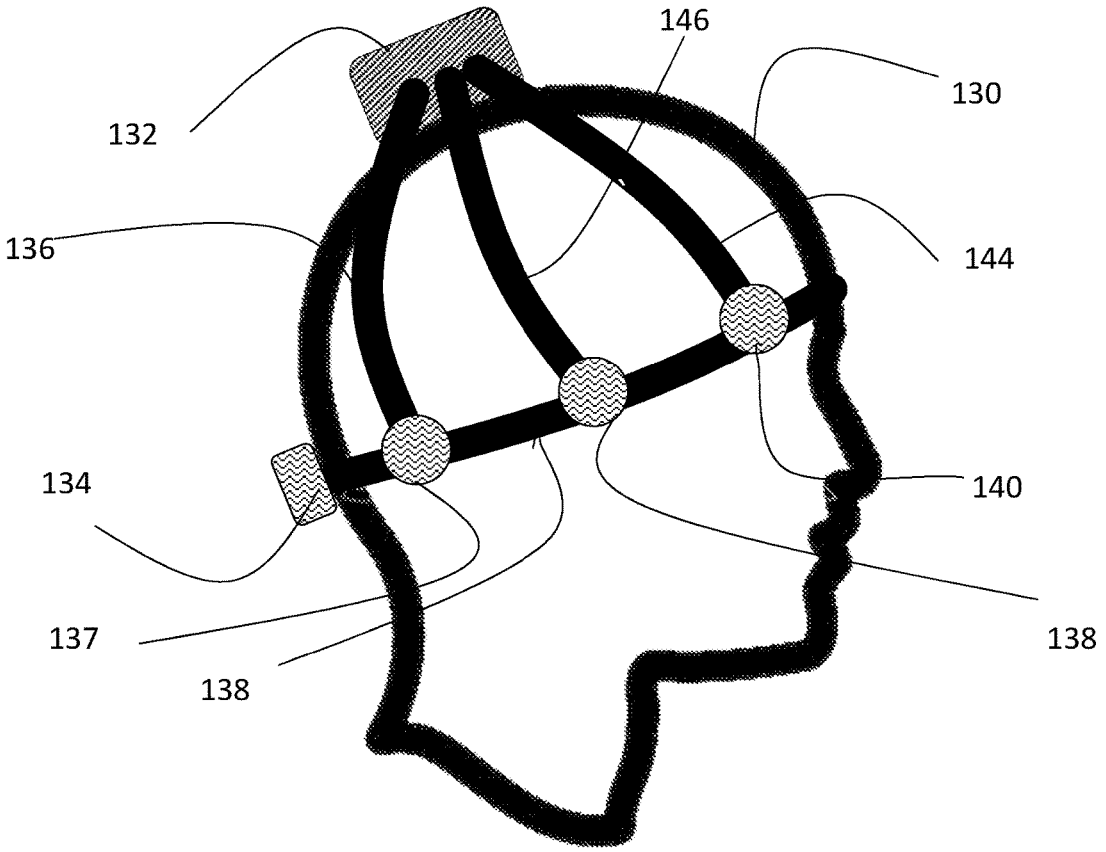

Attention is now directed to FIGS. 8A and 8B.

A strap system for securing a helmet 130 to a user's head is shown. The helmet is stably fixed to the head of the patient to withstand moments in all three dimensions, pitch, roll, and yaw. Such as in contrast to conventional helmets, such as motorcycle or construction worker's helmet, which protect the head but do not have to withstand moments of the same magnitude. Device carrying helmets, like a combat helmet carrying IR binoculars, or a surgeons' helmet carrying magnifiers and projectors, need to withstand pitch moments but very small yaw and roll moments. The present embodiment has a strapping system for helmets that can sufficiently withstand moments in all three dimensions.

A horizontal, latitudinal band 138 or 127 is strapped around the user's skull 128 so that it passes below the occipital bone 129 and is strapped by a conventional strapping fastener 134. This strap circumference is smaller than the skull circumference at the occipital bone, so the strap cannot move upwards.

A set of longitudinal straps 136, 144, 146, and others not shown, which total typically four or six in number, spaced around the skull 128 connect a payload 132 on top of the skull with the horizontal strap 138. These straps are fastened by conventional fasteners 137, 138, 140.

When all latitudinal and longitudinal straps are fastened, the payload 132 is fixed on the skull unable to slide about the surface of the head. Unlike other types of helmet fastening systems that fasten the helmet to the head with one latitudinal strap and one longitudinal strap going down under the chin, the present invention shows a trapping system that fastens the helmet to the head with one latitudinal strap and a plurality of longitudinal straps going up. A down-going strap can be included to increase the stability of the payload.

Figure 9:
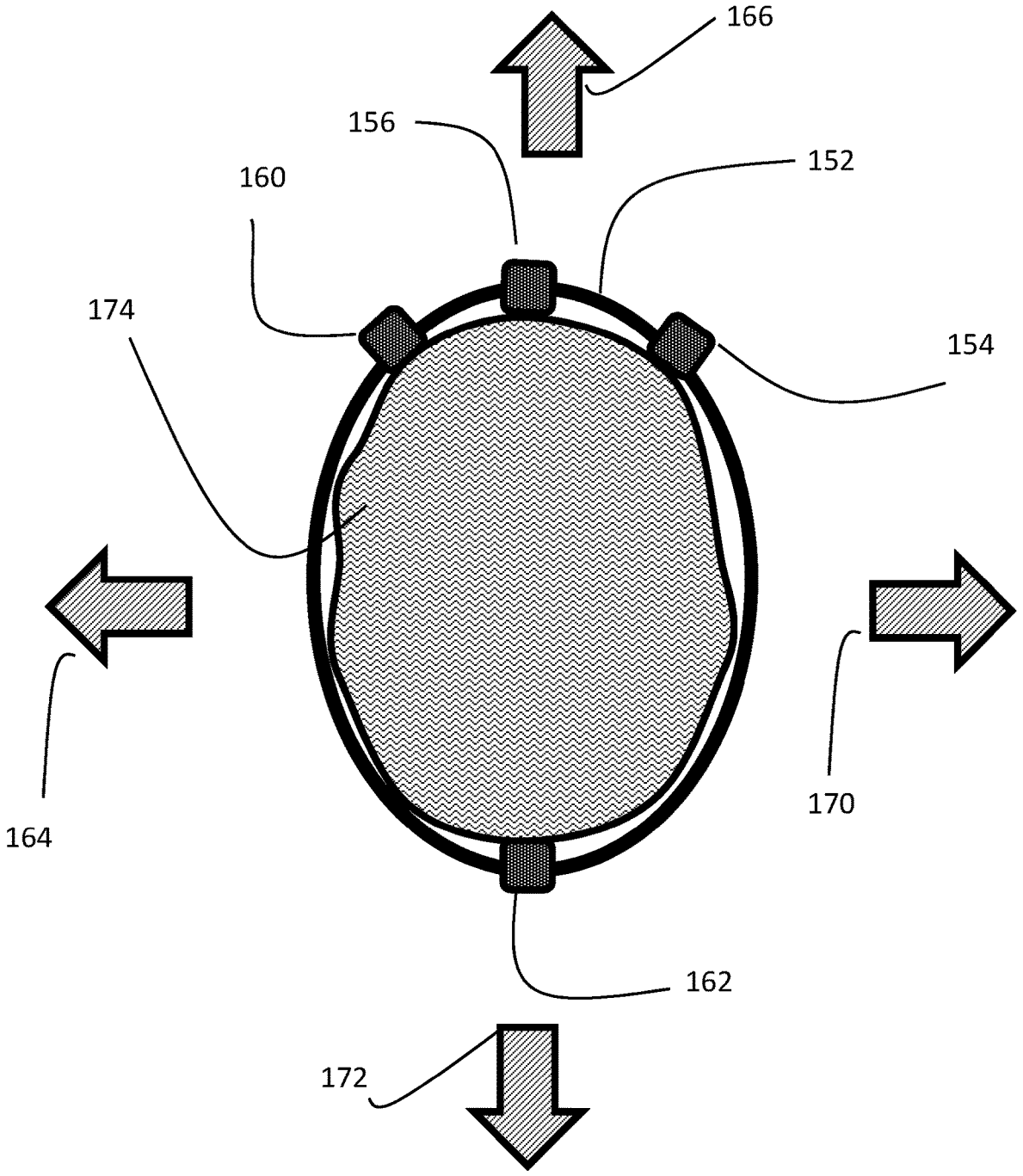
FIG. 9 shows the positioning of vibrators to provide multidimensional feedback to a user regarding the position of his/her head.

Attention is now directed to FIG. 9, illustrating a mechanism that provides multidimensional feedback to a user on the position of his/her head. Specifically, four actuators indicate excessive head tilt in one or more of left, right, forward, and backward directions.

In this embodiment, four channels of feedback signals are provided to the user's skull 174 by a head-wearable device 152 using four vibrators 160, 156, 154, and 162. Each of the vibrators is positioned against a skull bone so that a relatively weak vibration will be easily sensed by the user. The four vibrators are assigned to the four main directions—vibrator 156 is assigned to the front direction 166, vibrator 162 is assigned to the back direction 172, and vibrators 160 and 154 are assigned to the side directions 164 and 170, respectively. The user can distinguish between the vibrators by their unique vibration frequencies or by their unique vibration amplitude modulation or by sensing their location on the head, depending on the embodiment.

In this embodiment, the positions of the side vibrators 160, 154 are not identical to the directions that they indicate, that is, they are not positioned at the farthest points left and right of the user's head. Advantageously, they are more easily sensed because they contact bone, which enables the user to quickly learns to interpret them correctly.

Figure 10:
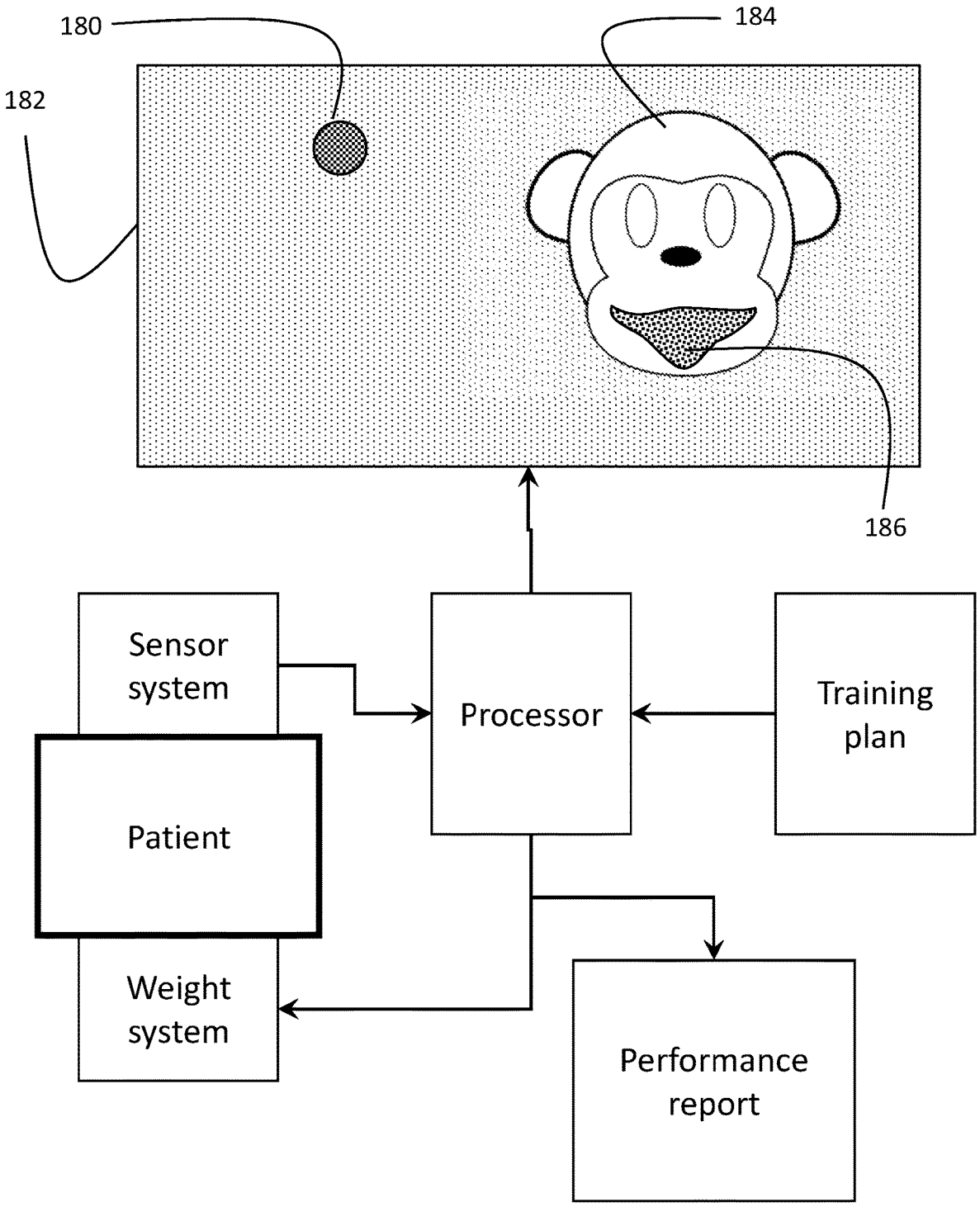
FIG. 10 shows a training exercise for a user of an embodiment of the invention.

Attention is now directed to FIG. 10. A processor controls the azimuth and radius of a weight on a user's head as shown in FIGS. 2-4 above. A sensor system gives the processor an indication on the head orientation of the user. The processor generates a dynamic graphic scene 184 on a computer or television display 182. It displays a mark 180 indicating the relative position of the head of the patient, and another mark 186 indicating a goal for the user. The user is instructed to move his head so that the mark 180 will be brought to the goal location 186. The goal can move across the screen according to some script of the training. The mark 186 can be expanded into a graphic design and become a part of a game. The mark 180 can be made to resemble a ball or a bird or some other mobile object. The system has to be calibrated to the position of the wearable part of the system on the user's head, and this can be done by instructing the user to bring the mark 180 to the corners of the screen.

Figure 11:
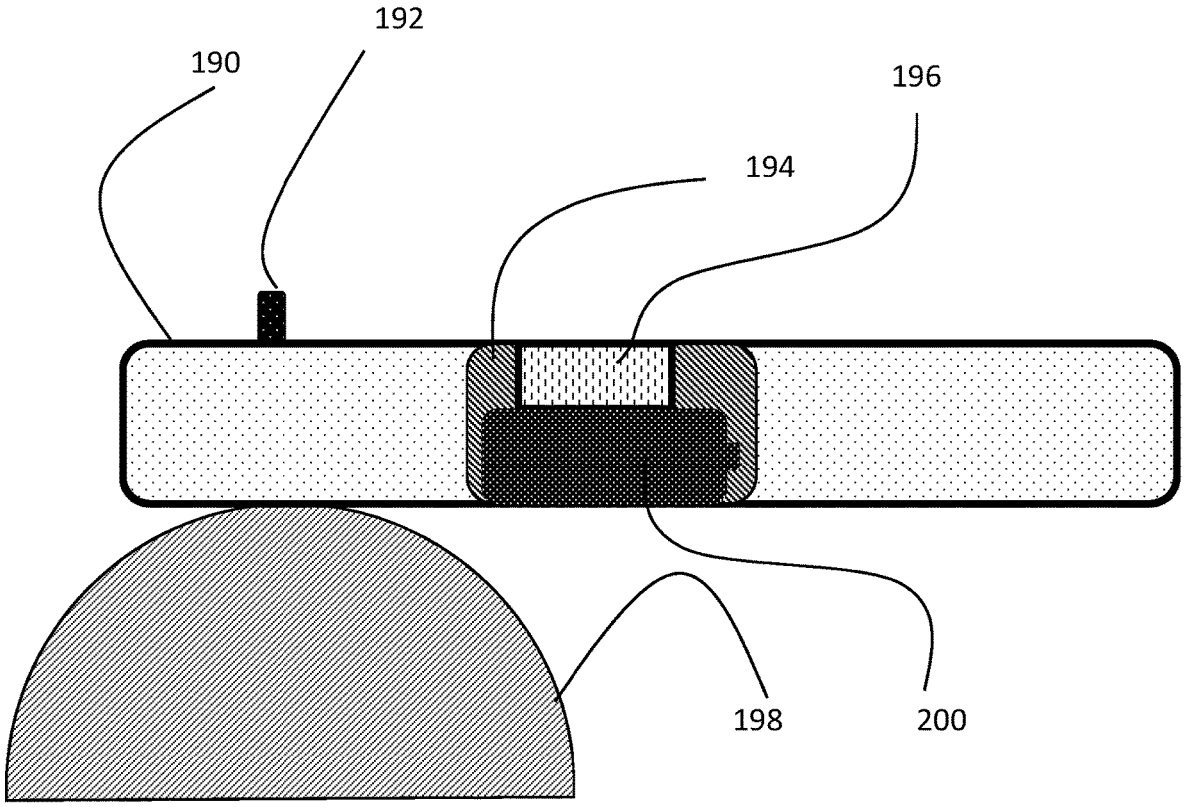
FIG. 11 shows battery weights used in an embodiment of the invention.

Attention is now directed to FIG. 11.

A helmet 198 carries an eccentric arm 190 along which a carriage 194 is configured to move radially. The carriage has a weight and some electronic circuits 196. The arm 190 can rotate around the helmet in a horizontal plane around a vertical axis 192. It is desired that the moment of the carriage on the helmet will be variable between zero and a maximum value. The moment is varied by changing the distance between the weight and the axis 192.

The system is powered by one or more batteries 200. In a preferred embodiment of the invention, the batteries are serving as a part of the weight and are a part of the carriage 194. This saves on the weight of the system that a user must wear on his head.

Having thus described exemplary embodiments of the invention, it will be apparent that various alterations, modifications, and improvements will readily occur to those skilled in the art. Alternations, modifications, and improvements of the disclosed invention, though not expressly described above, are nonetheless intended and implied to be within spirit and scope of the invention. Accordingly, the foregoing discussion is intended to be illustrative only; the invention is limited and defined only by the following claims and equivalents thereto.

What is claimed is:

1. A neck muscle exercise system comprising:

a headset;

a rigid arm mounted on the headset; and a motor mounted on the rigid arm, the motor enabling the rigid arm to apply a periodically-changing moment to the headset; wherein the moment is generated by a radial and azimuthal moving weight.

2. The system as in claim 1, wherein weight is eccentrically rotating.

3. The system as in claim 2 wherein the axis of rotation of the eccentric weight is one of the roll, the pitch and the yaw axes.

4. The system as in claim 1 further comprising:

a generator of a corrective audial signal to the user;

wherein the corrective audial signal is activated according to the user's head orientation.

5. The system as in claim 4, wherein the head orientation is determined by an inclinometer.

6. The system as in claim 5, wherein the inclinometer is embedded in a smartphone secured to the user's head.

7. The system as in claim 5, wherein the inclination sensors are solid state inertial measurement units.

8. The system as in claim 1 further comprising:

a module located on the top of the head with a mechanism that straps it to the user's head, said strap mechanism having:

a. at least one latitudinal strap adjusted to have a circumference smaller than the circumference of the skull at the occipital bone; and b. at least two longitudinal straps configured to pull the latitudinal strap towards the module;

wherein tightening the straps firmly attaches the module to the user's head.

9. The system as in claim 1 further comprising:

at least four vibrators contacting the user's skull bone and providing sensory outputs to the user by vibrating based on the inclination of the headset.

10. The system as in claim 9, wherein the outputs have unique distinguishable frequencies.

11. The system as in claim 9, wherein a first vibrator contacts the front of the user's skull, a second vibrator contacts the back of the user's skull, a third vibrator contacts the skull to the left of the center of the skull, and a fourth vibrator contacts the skull to the right of the center of the skull, and wherein the third and fourth vibrators are not positioned at the farthest left and right points, respectively, of the center of the skull.

12. The system as in claim 1 further comprising:

a. a dynamically-moving weight applying a tilt moment on the user's head;

b. a mechanism to graphically direct attention of a user to a target point on a screen;

c. a mechanism to sense the direction of the user's face; and d. a mechanism to record the deviation of the user's face direction from the target on the screen.

13. The system as in claim 12 further comprising:

at least one battery;

wherein the at least one battery is a part of the dynamically-moving weight.

14. A method for exercising neck muscles of a patient comprising:

a. providing a helmet with an arm configured to turn between predetermined angles around an essentially vertical axis;

b. mounting the helmet on a patient's head;

c. providing a weight on the rotating arm configured to slide radially between pre-determined radii;

d. sliding the weight in a trajectory along the rotating arm;

e. rotating the arm in a trajectory around the axis; and f. monitoring the orientation of the helmet in space while rotating the arm and sliding the weight.

* * * * *